US010252323B2

(12) United States Patent
Iguma et al.

(10) Patent No.: US 10,252,323 B2
(45) Date of Patent: Apr. 9, 2019

(54) MANUFACTURING METHOD FOR CYLINDER HEAD

(71) Applicant: TOYOTA JIDOSHA KABUSHIKI KAISHA, Toyota-shi, Aichi-ken (JP)

(72) Inventors: Hiroki Iguma, Shizuoka-ken (JP); Akio Kawaguchi, Shizuoka-ken (JP); Hideo Yamashita, Mishima (JP); Kazuaki Nishio, Nisshin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 192 days.

(21) Appl. No.: 15/363,007

(22) Filed: Nov. 29, 2016

(65) Prior Publication Data

US 2017/0209915 A1 Jul. 27, 2017

(30) Foreign Application Priority Data

Jan. 21, 2016 (JP) ..... 2016-009950

(51) Int. Cl.

| | |
|---|---|
| ***F02F 1/00*** | (2006.01) |
| ***B21K 3/02*** | (2006.01) |
| ***C23C 4/10*** | (2016.01) |
| ***F02B 77/00*** | (2006.01) |
| ***C23C 4/01*** | (2016.01) |
| *F02F 1/24* | (2006.01) |
| *F02F 1/42* | (2006.01) |

(52) U.S. Cl.

CPC ..... *B21K 3/02* (2013.01); *C23C 4/01* (2016.01); *C23C 4/10* (2013.01); *F02B 77/00* (2013.01); *F02F 1/42* (2013.01); *F02F 1/24* (2013.01); *F02F 1/4285* (2013.01); *F02F 2200/06* (2013.01)

(58) Field of Classification Search

CPC .... B21K 3/02; C23C 4/01; C23C 4/10; F02B 77/00; F02F 1/42; F02F 1/24; F02F 2200/06; F02F 1/4285

See application file for complete search history.

(56) References Cited

U.S. PATENT DOCUMENTS

| | | | | |
|---|---|---|---|---|
| 3,318,281 A * | 5/1967 | Plegat | ..... | C23C 4/12 118/672 |
| 3,607,381 A * | 9/1971 | Fairbairn | ..... | H05K 1/053 427/259 |
| 4,031,268 A * | 6/1977 | Fairbairn | ..... | H05K 3/14 118/301 |

(Continued)

FOREIGN PATENT DOCUMENTS

| | | |
|---|---|---|
| JP | H10220277 A | 8/1998 |
| JP | 2012-159059 A | 8/2012 |

(Continued)

*Primary Examiner* — Richard Chang

(74) *Attorney, Agent, or Firm* — Hunton Andrews Kurth LLP

(57) ABSTRACT

A manufacturing method for a cylinder head is described. A masking member is attached to cylinder head material, which followed by a film formation step. The masking member comprises a mask portion to mask the matching surface with the cylinder block, and mask portions to mask each of the openings of the intake ports, the exhaust ports, and the CPS hole. Mask portions are linked directly to other mask portions without any steps.

4 Claims, 8 Drawing Sheets

(56) References Cited

U.S. PATENT DOCUMENTS

| | | | | | |
|---|---|---|---|---|---|
| 5,573,814 | A * | 11/1996 | Donovan | C23C 4/16 | 427/448 |
| 6,017,591 | A * | 1/2000 | Popoola | B23H 9/008 | 219/69.17 |
| 6,060,117 | A * | 5/2000 | Pergande | C23C 4/01 | 427/224 |
| 6,925,981 | B2 * | 8/2005 | Ibukuro | F02F 1/10 | 123/193.2 |
| 7,032,560 | B2 * | 4/2006 | Katou | F02B 31/08 | 123/193.5 |
| 7,458,358 | B2 * | 12/2008 | Lineton | B23K 26/34 | 123/193.6 |
| 8,985,049 | B2 * | 3/2015 | Bellino | B08B 17/02 | 118/504 |
| 9,353,702 | B2 * | 5/2016 | Sharp | F02F 7/0095 | |

FOREIGN PATENT DOCUMENTS

| | | | |
|---|---|---|---|
| JP | 2014020301 | A | 2/2014 |
| JP | 2014156790 | A | 8/2014 |

* cited by examiner

MANUFACTURING METHOD FOR CYLINDER HEAD

CROSS-REFERENCE TO RELATED APPLICATION

The present application claims priority to Japanese Patent Application No. 2016-009950 filed on Jan. 21, 2016, which is incorporated herein by reference in its entirety.

BACKGROUND

Technical Field

The present application relates to a manufacturing method for a cylinder head, and more particularly, to the manufacturing method for a cylinder head with a surface on which a heat shield film (a heat insulation film) is formed.

Background Art

A combustion chamber of an engine is generally defined as surrounded space by a boa surface of a cylinder block, a top surface of a piston stored inside the bore surface, a bottom surface of a cylinder head, a bottom surface of an umbrella part of an intake valve which is disposed at an intake port formed in the cylinder head, and bottom surface of an umbrella part of an exhaust valve which is disposed at an exhaust port formed in the cylinder head.

In such a combustion chamber, a heat shield film may be formed on the top face of the piston and the like that constitute walls of the combustion chamber in order to reduce a cooling loss within an engine. For example, JP2012-156059A discloses an art in which an anode oxidation film (specifically an alumite film) is formed as a heat shield film on a bottom surface of a cylinder head that constitute walls of a combustion chamber of a spark ignition type engine. The publication mentioned above also discloses that the bottom surface has holes corresponding to an intake port, an exhaust port and a spark plug, which are preferably masked during anodizing treatment of the bottom surface.

LIST OF RELATED ART

Following is a list of patent document which the applicant has noticed as related arts of the present application.

Patent Literature 1: JP 2012-156059A

SUMMARY

The masking of the holes of the bottom surface are carried out by inserting a suitable masking member into each of the holes, for example. Such an insertion of masking member is applied not only to a film formation method in which a heat insulation film is formed by oxidation of the surface but also to a film formation method with an injection of film material particles such as thermal spray method and cold spray method in which the particles are deposited on the bottom surface.

The combustion chamber may be provided with an engine-related part in addition to the intake valve and the like mentioned above. When disposing such an engine-related part in a cylinder head, an exclusive hole have to be formed on the bottom surface. Due to the restriction in space of the cylinder head, however, such an exclusive hole should be formed at a slant from a vertical direction of a matching surface of the cylinder head with a cylinder block (hereinafter also referred to as "the matching surface with the cylinder block").

In the anodizing treatment mentioned above where an electrolyte is used, there is little restriction on the shape of a masking member inserted into a hole of the bottom surface. This is because the bottom surface can be anodized as far as the electrolyte contacts therewith. Therefore, in the anodizing treatment, the shape of the masking member used for the vertical hole and the slant hole can be selected from a wide choice of options. In contrast to the above, the injection of the film material particles is carried out from the direction opposed to the matching surface with the cylinder block. For that reason, the film formation method with the injection of the film material particle has a drawback of many restrictions in the shapes of the masking member for the slant hole.

Specifically, it is necessary for the masking member for the slant hole to comprise a positioning part that is inserted into to the slant hole for positioning the masking member and a grip part for the withdrawal of the masking member from the slant hole. Also, it is necessary to insert this positioning part into the slant hole to some extent for ensuring the positioning of the masking member. Then, it is hard to pull up the masking member in the vertical direction of the matching surface with the cylinder block because the positioning part will be caught on an aperture of the slant hole. From the above, in the film formation method with the injection of the film materials particle, there is a problem with the masking member for the slant hole and thus, there is room for the improvement.

In view of at least one of above described problems, an object of the present application is to provide a useful masking technique for a film formation in which film material particles are injected into a vertical hole for an engine-related part that is formed at a slant from a vertical direction of a matching surface with a cylinder block.

The present application provides a manufacturing method for a cylinder head comprises a preparation step, an attaching step, a film formation step and a detaching step. The preparation step is a step for preparing a cylinder head material having in the same plane a matching surface with a cylinder block and a wall constituent surface of an engine combustion chamber, wherein the wall constituent surface has port holes that correspond to an intake port and an exhaust port, and a slant hole for an engine-related part that is different from the port holes and slants from a vertical direction of the matching surface with the cylinder block. The attaching step is a step for attaching the cylinder head material to a masking member that is configured to mask a non-film formation area of the wall constituent surface and the matching surface with the cylinder block. The film formation step is a step for, after the attachment of the masking member, injecting film material particles in a direction opposed to the matching surface with the cylinder block to form a heat shield film. The detaching step is a step for detaching the masking member from the cylinder head material after the formation of the heat shield film.

The masking member comprises a matching surface mask portion, port hole mask portions and a slant hole mask portion. The matching surface mask portion is configured to mask the matching surface with the cylinder block. The port hole mask portions are configured to link to the matching surface mask portion directly and to mask each of openings of the port holes. The slant hole mask portion is configured to link to any one of the port hole mask portions directly and to mask an opening of the slant hole.

In the present application, when the center of the opening of the slant hole is positioned between any two consecutive openings of the port holes and also positioned closer to one of the two consecutive openings of the port holes, the slant hole mask portion may be configured to link directly to a port hole mask portion that is configured to mask one of the two consecutive openings being positioned closer to the center of the opening whereas not to link directly to a port hole mask portion that is configured to mask one of the two consecutive openings being positioned farther to the center of the opening.

In the present application, when the intake port includes a tangential port and a helical port, and the center of opening of the slant hole is positioned between the opening of the tangential port and the opening of the helical port, the slant hole mask portion may be configured to link directly to a port hole mask portion that is configured to mask the opening of the tangential port whereas not to link directly to a port hole mask portion that is configured to mask the opening of the helical port.

In the present application, when the intake port includes a tangential port and a helical port, and the center of opening of the slant hole is positioned between the opening of the tangential port and the opening of the helical port, the slant hole mask portion may be configured to link directly to a port hole mask portion that is configured to mask the opening of the helical port whereas not to link directly to a port hole mask portion that is configured to mask the opening of the tangential port.

According to the present application, since the slant hole mask portion is configured to link to any one of the port hole mask portions directly and to mask an opening of the slant hole, the user does not need to user a masking member having the positioning part mentioned above. In addition, the present application makes it possible to suppress a force acting on the edge of the heat shielding film only the force acting along the removing direction during the detaching step. Therefore, the present application makes it possible to prevent the heat shield film from peeling off during the detaching step and to obtain a high-quality heat shield film.

DETAILED DESCRIPTION

Figure 1:
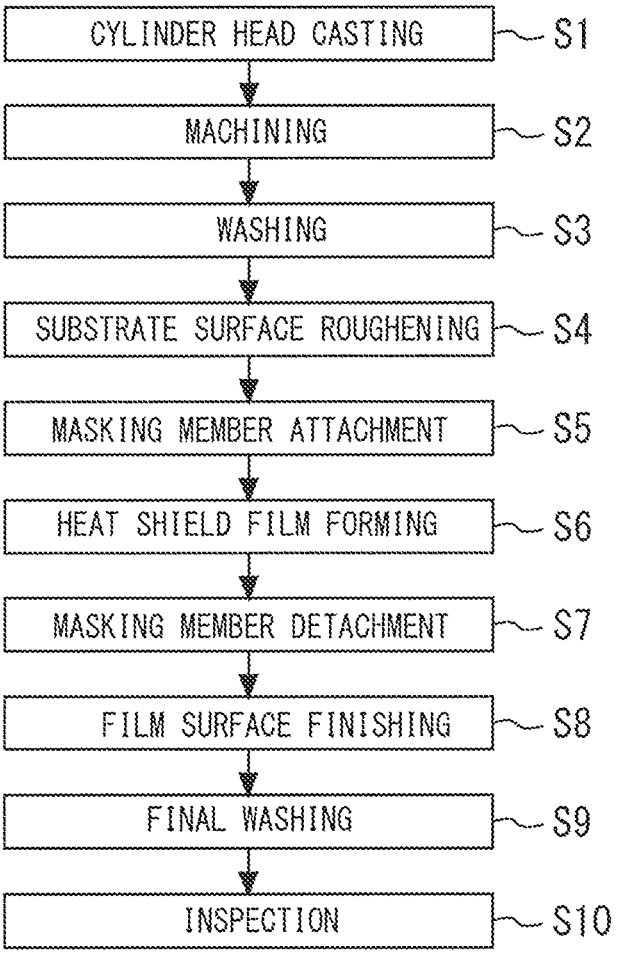
FIG. 1 is a diagram for describing a flow of a manufacturing method of a cylinder head of an embodiment of the present application.

Embodiments of the present application are described hereunder referring to figures. Note that elements that are common to the respective drawings are denoted by the same reference characters and a duplicate description thereof is omitted. Further, the present application is not limited to the embodiments described hereunder.

Manufacturing Method for a Cylinder Head

FIG. 1 is a diagram for describing a flow of a manufacturing method of a cylinder head (specifically, a cylinder head for a compression self-ignition type engine) of an embodiment of the present application. In this embodiment, at first, a casting of a cylinder head is carried out (step S1). In the step S1, a plurality of cores to form an inner spatial area of the cylinder head such as an intake port to attach an intake valve, an exhaust port to attach an exhaust valve and a water jacket are installed to predetermined positions of a plurality of dies to form an outer shape of the cylinder head. Then a base material (e.g., aluminum alloy) of the cylinder head is poured into the dies to be molded. Then a casting product (hereafter simply referred to as "cylinder head material") is removed from the dies while the cores are crushed to remove.

Following the step S1, a machining of the cylinder head material is carried out (step S2). In the step S2, specifically, a hole for housing an injector (hereinafter referred to as "an injector hole"), holes for housing bolts to install the cylinder head into a cylinder block (hereinafter referred to as "bolt holes"), a hole for housing a glow plug-integrated cylinder internal pressure sensor (hereinafter referred to as "a CPS hole") and valve guides for supporting the intake valve and the exhaust valve are formed with a drill. Here, the injector hole and the bolt holes are formed in a vertical direction to a matching surface of the cylinder head with a cylinder block 10*b*. Whereas, the CPS hole is formed at a slant from the vertical direction of the matching surface with the cylinder block 10*b*.

Figure 2:
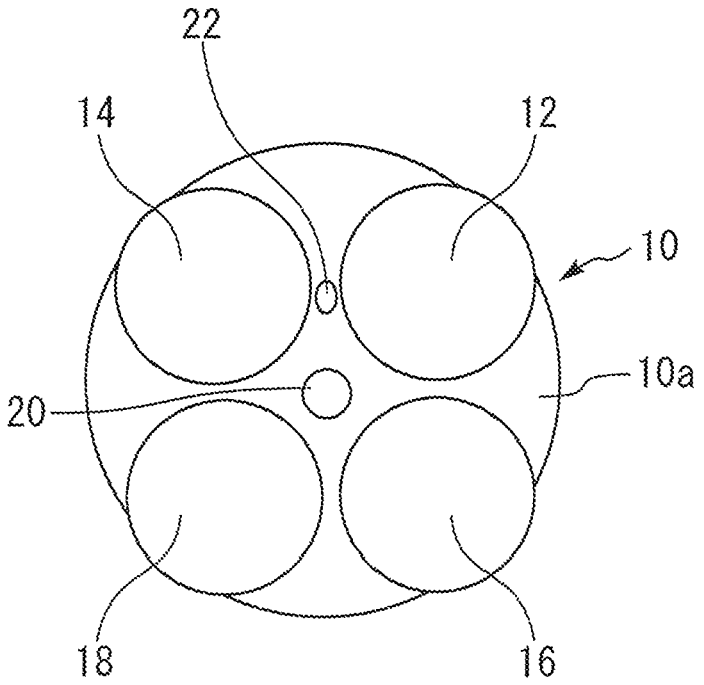
FIG. 2 is a schematic diagram for showing an area, after a machining of a step S2 of FIG. 1, to which a wall constitute surface of a combustion chamber correspond within a surface of a casting product of a cylinder head.

FIG. 2 is a schematic diagram for showing an area, after the machining of the step S2, to which a wall constitute surface of a combustion chamber correspond within a surface of the cylinder head material. As shown in FIG. 2, the injector hole 20 is formed on the central part of the cylinder head material 10 (more properly, the central part of wall constitute surface 10*a* of the surface of the cylinder head material 10). The intake ports 12 and 14 and the exhaust ports 16 and 18 are formed so as to surround this injector hole 20. The CPS hole 22 is formed between the intake holes 12 and 14. The bolt holes are formed on the matching surface with the cylinder block 10*b* located outside of the wall constitute surface 10*a* shown in FIG. 2.

Following the step S2, a washing of the machined cylinder head material is carried out (step S3). This step is carried out for the reason that if the cylinder head material contains foreign matters such as sand of the core occurred by the crush in the step S1 and cutting waste occurred by the machining in the step 2, the quality of a final product, i.e. an engine, will be declined. Another reason for the step S3 is to avoid an influence on a film formation in the step S6 described below. In the step S3, specifically, washings are injected to the intake port 12, the injector hole 20 and the like shown in FIG. 2 thereby foreign matters are removed therefrom.

Following the step S3, a roughening a predetermined area of the surface of the cylinder head material (substrate surface) is carried out (e.g., water jet, sandblast, laser material processing, and the like) (step S4). This step is carried out for the reason that if the roughness of the predetermined area is intentionally deteriorating, a coherence power of the heat shield film formed thereon is improved due to an anchor effect. Here, the predetermined area is comparable to a film formation area, in particular, the whole area of the wall constitute surface 10*a* shown in FIG. 2. Note that if the film formation area is a part of the wall constitute surface 10*a* (e.g. a part of the surface around the injector hole 20), the predetermined area shall be reduced.

Figure 3:
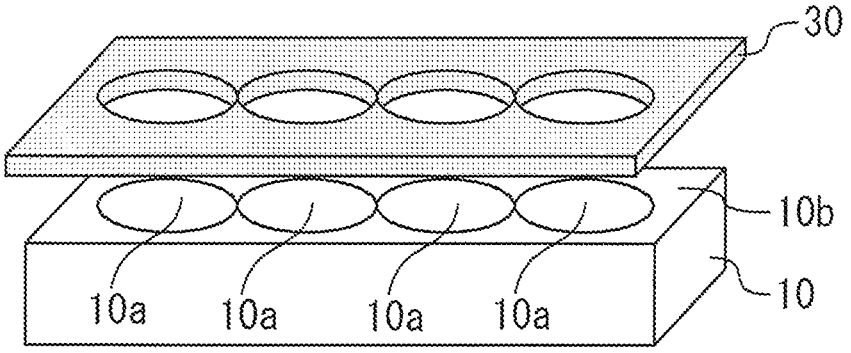
FIG. 3 is a diagram for describing a step S5 of FIG. 1.
Figure 4:
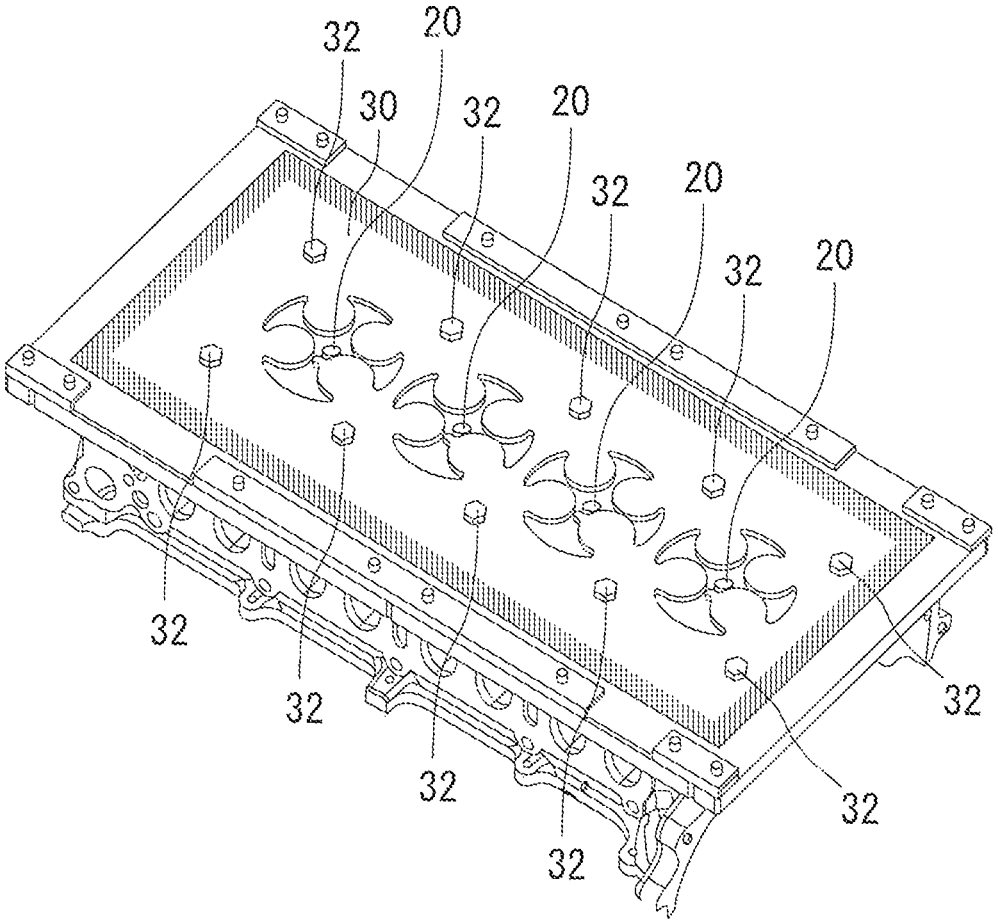
FIG. 4 is a diagram for describing a step S5 of FIG. 1.

Following the step S4, an attachment of the masking member is carried out (step S5). This step S5 is described with reference to FIG. 3 to FIG. 6. Note that the cylinder head material and the masking member are simplified in FIG. 3 for convenience of the explanation. As shown in FIG. 3, a plate-like masking member 30 is attached to the cylinder head material 10 in this step S5. FIG. 4 is a diagram for showing the cylinder head material 10 to which the masking member 30 is attached. A plurality of knock pins 32 are positioning pins which are inserted into the bolt holes through the masking member 30. By the positioning pins, the masking member 30 is positioned at a predetermined position within the surface of the cylinder head material 10 (more properly, the matching surface with the cylinder block 10*b*) and the masking member 30 is appressed to the surface of the cylinder head material 10.

Figure 5:
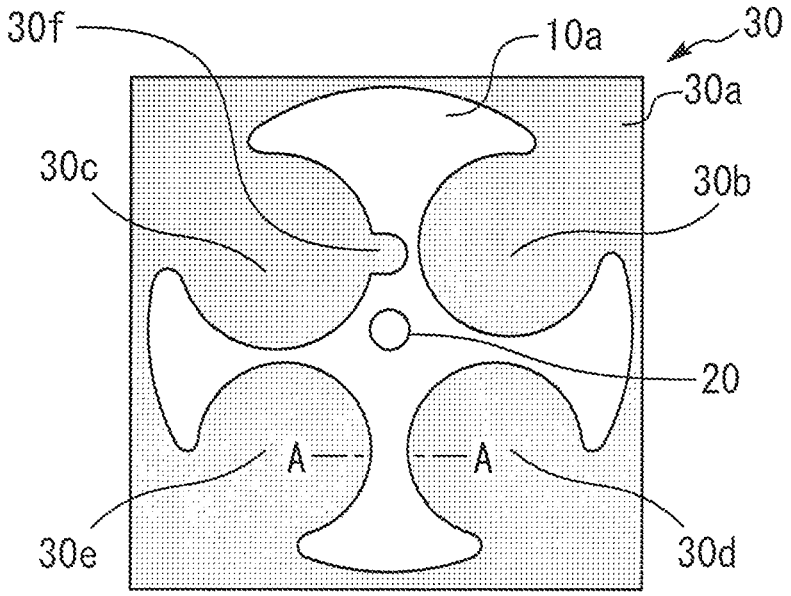
FIG. 5 is a diagram for showing a part of a masking member which is attached to the casting product of the cylinder head.

FIG. 5 is a diagram for showing a part of the masking member which is attached to the casting product of the cylinder head. This figure describes a square area among four of the knock pins 32 shown in FIG. 4. As shown in FIG. 5, the masking member 30 comprises a mask portion 30*a* to the mask the matching surface with the cylinder block 10*b*, mask portions 30*b*, 30*c*, 30*d* and 30*e* to mask each of openings of the intake ports and the exhaust ports, and a mask portion 30*f* to mask an opening of the CPS hole.

The mask portion 30*a* is linked directly to the mask portions 30*b*, 30*c*, 30*d* and 30*e* without any steps, and the mask portion 30*c* is linked directly to the mask portion 30*f* without a step. Here, when two mask portions are linked without other mask portions, it is meant that the one mask portion is "linked directly to" the other mask portion. For example, the mask portion 30*a* is linked to the mask portion 30*f* through the mask portion 30*c*, but it is not true that the mask portion 30*a* is linked directly to the mask portion 30*f*. Note that the injector hole 20 is exposed in FIG. 5, where an exclusive masking member being independent of the masking member 30 will be inserted before the step S6 described below.

Figure 6:
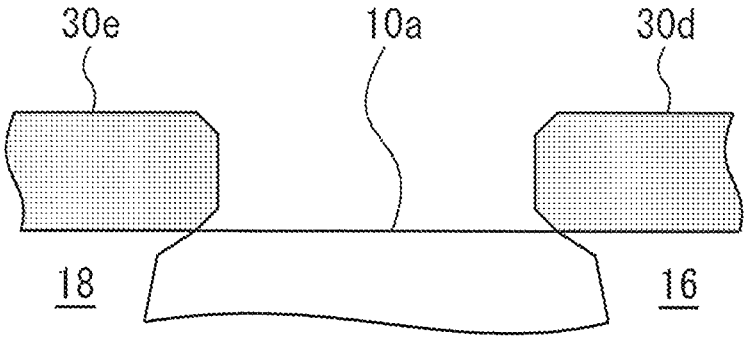
FIG. 6 is a diagram for describing a step S5 of FIG. 1.

FIG. 6 is a diagram for showing a cutting surface of the cylinder head material and the masking member in the A-A line shown in FIG. 5. As shown in FIG. 6, the bottom surfaces of the mask portions 30*d* and 30*e* have chamfered edges with which the opening edges of the exhaust ports 16 and 18 are contact respectively. Actually, the edge of the bottom surface of the mask portions 30*d* (or the mask portion 30*e*) contacts along the opening edges of the exhaust port 16 (or the exhaust port 18). As the mask portions 30*d* and 30*e*, the bottom surfaces of the mask portions 30*b*, 30*c* and 30*f* have chamfered edges respectively. The edge of the bottom surface of the mask portions 30*b* and 30*c* contact with the opening edges of the intake ports 12 and 14 respectively, and the bottom surface of the mask portions 30*f* contacts with the opening edges of the CPS hole 22.

Figure 7:
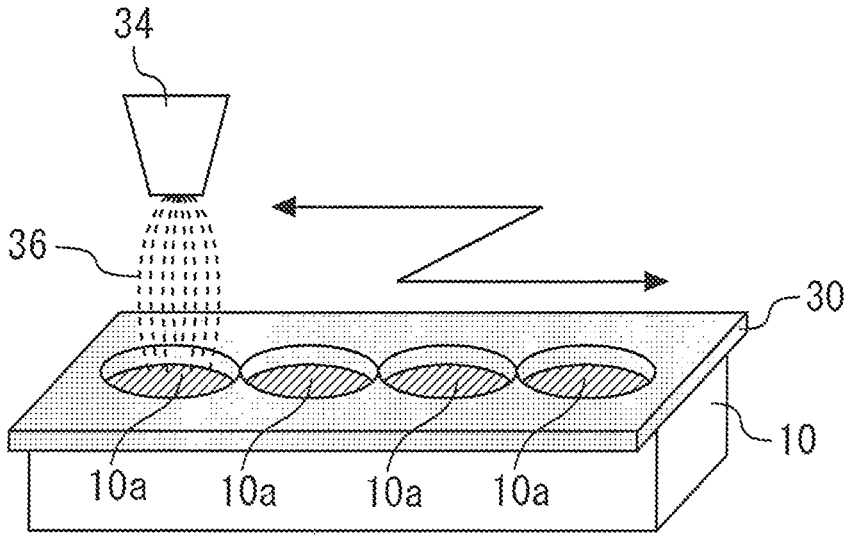
FIG. 7 is a diagram for describing a step S6 of FIG. 1.

Following the step S5, a film formation of the heat shield film is carried out (step S6). This step S6 is described with reference to FIG. 7. Note that the cylinder head material and the masking member are simplified in FIG. 7 for convenience of the explanation. As shown in FIG. 7, film material particles 36 (e.g., chrome-nickel steel-based ceramics particles, zirconia particles, and the like) on a carrier (e.g., plasma jet, compressed air, a fuel gas, an inert gas, and the like) are injected from a nozzle 34 in this step S6. During the injection from the nozzle 34, the nozzle 34 is reciprocated in a longitudinal direction of the cylinder head material 10 while a tip of the nozzle 34 is kept vertical to the surface of the masking member 30 (more properly, the matching surface with the cylinder block 10*b*). In this manner, a heat shield film having a desired thickness depending on heat properties (e.g. 50 to 200 μm) is formed on the wall constitute surface 10*a*. However, the tip of the nozzle 34 does not have to be vertical to the surface of the masking member 30 exactly and may incline to some extent. In this case, it is desirable to keep an injection direction of the film material particles 36 being vertical to the film formation area.

Figure 8:
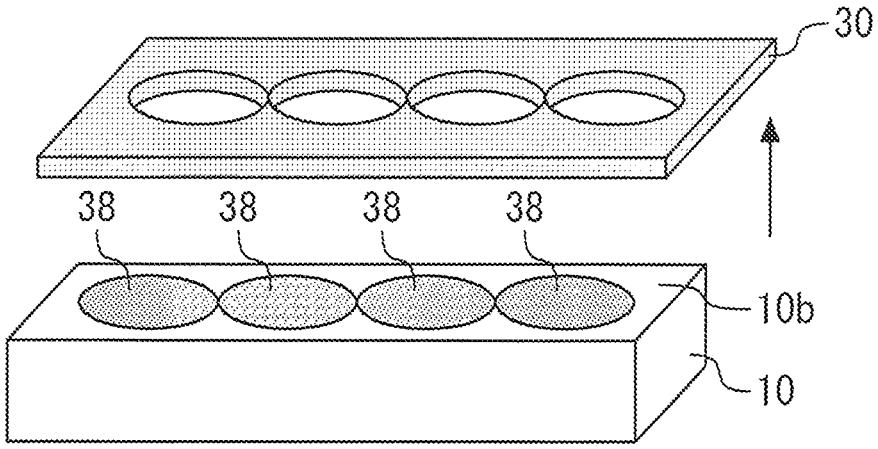
FIG. 8 is a diagram for describing a step S7 of FIG. 1.

Following step S6, a detaching of the masking member 30 is carried out (step S7). This step S7 is described with reference to FIG. 8. Note that the cylinder head material and the masking member are simplified in FIG. 8 for convenience of the explanation. As shown in FIG. 8, the masking member 30 is detached from the cylinder head material 10 on which a heat shield film 30 is formed. During the detachment, the masking member 30 is moved in a direction vertical to the matching surface with the cylinder block 10*b*. However, the direction of the movement does not have to be vertical to the matching surface with the cylinder block 10*b* exactly. That is, the direction of the movement can be inclined in a range that a peeling of the heat shield film 38 does not occur. For example, the masking member 30 may be detached by moving in a direction of tilt of the CPS hole 22. Note that before the detachment, the knock pins 32 shown in FIG. 4 are removed from the bolt holes. Also, the exclusive masking member mentioned above is detached from the injector hole before or after the detachment of the masking member 30.

Figure 9:
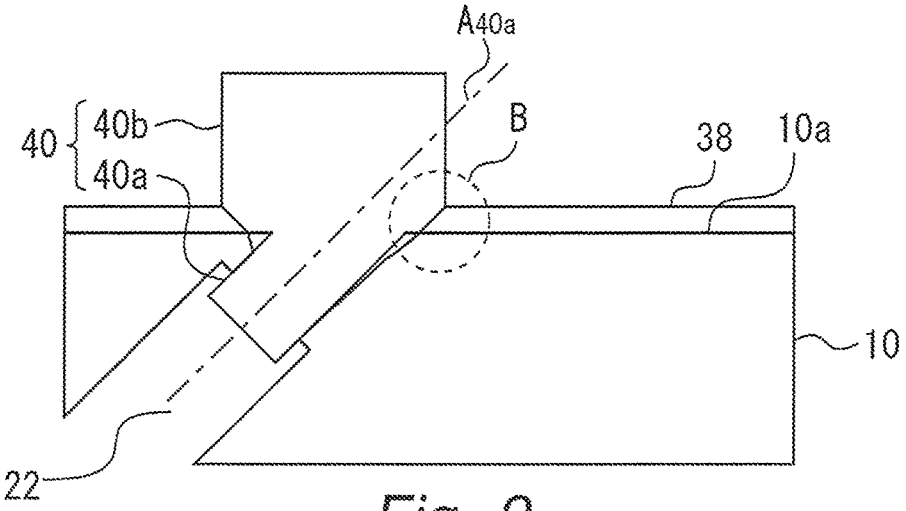
FIG. 9 is a diagram for describing conventional problems.
Figure 10:
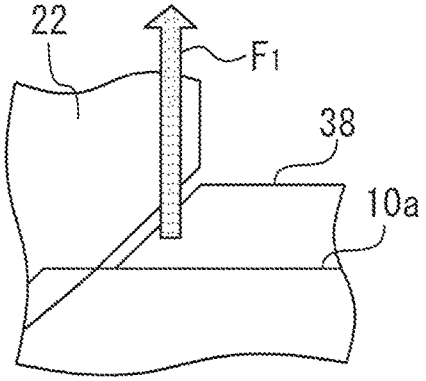
FIG. 10 is a diagram for describing conventional problems.
Figure 11:
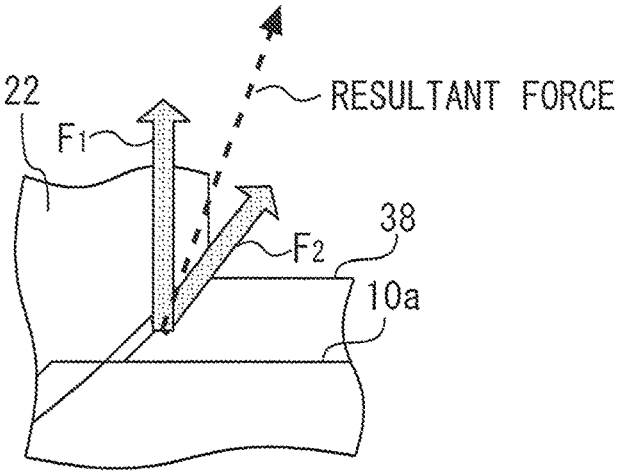
FIG. 11 diagram for describing conventional problems.

Here, conventional problems are described specifically with reference to FIG. 9 to FIG. 11. FIG. 9 is a diagram for describing a condition where a masking member 40 is positioned at the opening of the CPS hole 22. The masking member 40 comprises a positioning part 40*a* that has an outer shape corresponding to a shape of the opening of the CPS hole 22 and a grip part 40*b* that is formed to insert the masking member 40 into the opening and to also to withdraw the masking member 40 from the opening. As shown in FIG. 9, the positioning part 40*a* slants from the vertical direction of the matching surface with the cylinder block outside the wall constitute surface 30*a*. On the other hand, the grip portion 40*b* spreads in a direction that is vertical to the matching surface with the cylinder block. Further, the part of the grip portion 40*b* near the positioning part 40*a* has a taper shape that has a diameter reducing as it approaches the positioning part 40*a*.

FIGS. 10 and 11 are enlarged views of the part surrounded in broken line B shown in FIG. 9. FIG. 10 corresponds to a case where the masking member 40 in a posture of FIG. 9 is lifted up in a direction vertical to the matching surface with the cylinder block 10*b* located outside of the wall constitute surface 10*a*. FIG. 11 corresponds to a case where the masking member 40 in a posture of FIG. 9 is lifted up in a direction opposite to its insert direction. In the case shown in FIG. 10, a force $F_1$ (pull force) in a direction vertical to the matching surface with the cylinder block acts on the edge of the heat shield film 38. In the case shown in FIG. 11, on the other hand, a resultant force by a force $F_2$ (shear force) in the lift direction and the force $F_1$ (pull force) acts on the edge of the heat shield film 38. Compared between the two cases, a method in accordance with the case shown in FIG. 10 inhibits relatively the peeling of the heat shield film 38 where the force $F_1$ only acts on the edge of the heat shield film 38.

However, different from a masking member for the injector hole that has a vertical posture to the matching surface with the cylinder block during its insertion, it is difficult to establish the method with FIG. 10 in which the positioning part 40*a*, having a slant posture to the matching surface with the cylinder block during its insertion, is moved in the direction vertical of the matching surface with the cylinder block. That is, as can be seen from FIG. 9, it is necessary to insert the positioning part 40 into the inside of the CPS hole 22 to some extent. However, that makes hard for the positioning part 40 to withdraw because it will be caught on the opening of the CPS hole 22 during the withdrawal in the vertical direction to the matching surface with the cylinder block. For this reason, there is nothing for it but to choose the method with FIG. 11 in which the masking member 40 is lifted up in a direction opposite to its insert direction. In addition to that, since the distance between the opening edge of the CPS hole 22 and the opening edge of the intake port 12 or 14 is short, then the area of the film formation area around the opening of the CPS hole 22 is narrow. Therefore, in the method with FIG. 11, the peeling of the heat shield film 38 can occur by acting a force exceeding the adhesive force with the wall constitution surface 10*a* on the edge of the heat shield film 30 positioned around the opening of the CPS hole 22.

During the film formation, the grip part 40*b* of the masking member 40 shown in FIG. 9 tends to rotate on an axis $A_{40a}$ of the positioning part 40*a*. In such case, the masking member 40 goes up and there arises another problem in which the mask of the opening of the CPS hole 22 becomes insufficient. During the film formation, moreover, the film material particles 36 described in FIG. 7 adhere to a surface of the grip part 40*b*. Considering reuse of the masking member 40, it is desirable to remove the adhered particles from the surface of the grip part 40*b*. However, the size of the masking member 14 is small, which makes it difficult to remove the adhered particles.

In contrast to the above, in the masking member 30 described in FIG. 5, the mask portion 30*f* and the mask portion 30*c* are directly linked with each other, which helps prevent the masking member 40 shown in FIG. 9 from choosing for the film formation. In addition, according to the masking member 30 described in FIG. 5, the mask portion 30*a* is linked to the mask portion 30*f* without any steps, which helps to reduce the force on the edge of the heat shield film during the detachment of the masking member 30 described in the step 7 only with the force in the detachment direction. Therefore, the masking member 30 makes it possible to prevent the heat shield film from peeling off during the detachment and to obtain a high-quality heat shield film.

Also, in the masking member 30, the mask portions 30*a* to 30*f* are united to a single masking member, which helps to simplify the attachment in the step S4 and the detachment in the step S6. Compared with a case where the mask portion 30*f* is separated from the mask portions 30*a* to 30*e*, the united single masking member makes it possible to save a lot of trouble in the removal of the adhered film material particles. These advantages will help to promote reuse of the masking member 30 and also to enhance productivity of the cylinder head.

Referring back to FIG. 1, a finishing of the surface of the heat shield film is carried out after the step S7 (step S8). In this step S8, for example, a smoothing of the film surface and adjustment of the film thickness are carried out by a cutting with end mills and the like or a plane grinding with a whetstone. Parallel to this process, a machining of unprocessed portions such as the intake ports which were not processed in the machining of the step S2 and a formation surfaces for seating umbrella portions such as umbrella portions of the intake valves are carried out.

Following the step S8, a final washing of the cylinder head material is carried out (step S9). In the step S8, specifically, washings are injected to the intake port 12, the injector hole 20 and the like shown in FIG. 2 and the heat shield film thereby foreign matters such as cut chips generated in the finishing and the machining described in the step S8 are removed therefrom.

Following the step S9, an inspection of the cylinder head material is carried out (step S10). In the step S9, for example, inspections of the heat shield film and the shapes of the intake ports and the exhaust ports are carried out. After the step S10, the cylinder head on which the heat shield film is formed can be manufactured.

Note that in the embodiment mentioned above, the intake ports 12 and 14 and the exhaust ports 16 and 18 shown in FIG. 2 correspond to the "port holes" of the present application. The CPS hole 22 shown in FIG. 2 corresponds to the "slant hole" of the present application. The mask portion 30*a* shown in FIG. 2 corresponds to the "matching surface mask portion" of the present application. The mask portions 30*b* to 30*e* shown in FIG. 2 correspond to the "port hole mask portions" of the present application. The mask portion 30*f* shown in FIG. 2 corresponds to the "slant hole mask portion" of the present application.

Further, the steps from the step S1 through the step S4 shown in FIG. 1 correspond to the "preparation step" of the present application. The step S5 shown in FIG. 1 corresponds to the "attaching step" of the present application. The step S6 shown in FIG. 1 corresponds to the "film formation step" of the present application. The step S7 shown in FIG. 1 corresponds to the "detaching step" of the present application.

Other Manufacturing Methods for a Cylinder Head

Figure 12:
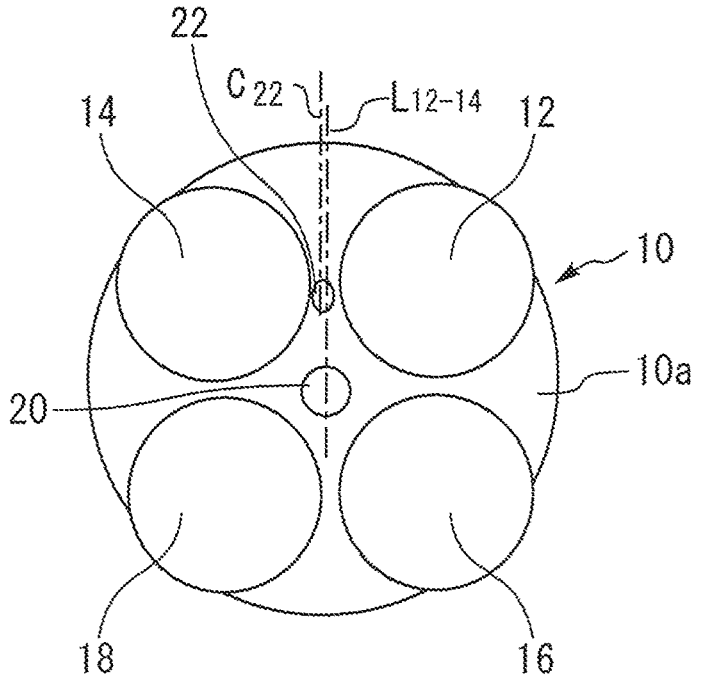
FIG. 12 is a diagram for describing another example of the position of a hole in which a glow plug-integrated cylinder internal pressure sensor is housed.

In the embodiment mentioned above, the CPS hole is formed between the two intake ports. However, the CPS hole does not necessarily have to be formed at this position. FIG. 12 is a diagram for describing another example of the position of the CPS hole. In the wall constitute surface 10*a* shown in FIG. 12, a center $C_{22}$ of the CPS hole 22 is closer to the intake port 14 than a center line $L_{12\text{-}14}$ between the intake ports 12 and 14. In this case, it is desirable to make a mask portion to mask the opening of the CPS hole 22 to link directly to a mask portion to mask the opening of the intake port 14 (see the mask portion 30 shown in FIG. 5). Thus, the area of the mask portion to mask the opening of the CPS hole 22 becomes narrower than the area of the mask portion 30*f* shown in FIG. 5.

In the embodiment mentioned above, since the mask portion 30*f* is linked directly to the mask portion 30*c*, total area of the heat shield film becomes narrowed than the case without the mask portion as the mask portion 30*f*. According to the CPS hole 22, since the area of the mask portion to mask the opening of the CPS hole 22 becomes narrower than the area of the mask portion 30*f* shown in FIG. 5, reduction in the total area of the heat shield film can be suppressed. Therefore, compared with the case of the heat shield film manufactured in accordance with the embodiment mentioned above, heat shielding performance of a combustion chamber of an engine can be improved when the heat shield film manufactured with reference to the method described in FIG. 12.

The position of the CPS hole is not restricted to the examples shown in FIGS. 2 and 12, and may be changed appropriately. For example, the CPS hole may be formed between the exhaust ports or formed between the intake port and the exhaust port. In these case, however, in is necessary to link the mask portion 30*f* to any one of the mask portions 30*b* to 30*e*. Then, reduction in the total area of the heat shield film arises as mentioned above. Therefore, it is desirable to design the masking member by arranging the position of the CPS hole so as to minimize the distance from an edge of a mask portion directly linked to the mask portion 30*f* (e.g. a mask portion to mask the closest port to the CPS hole).

In the embodiment mentioned above, the mask portion 30*f* is linked directly to the mask portion 30*c*. However, the mask portion 30*f* is further linked directly to the mask portion 30*f* in addition to the mask portion 30*c*. In this case, the total area of the heat shield film decreases in comparison to a case where the mask portion 30*f* is linked directly to one of the mask portion 30*c* and the mask portion 30*b*, whereas the peeling of the heat shield film around the mask portion 30*f* is inhibited during detachment of the masking member 30 from the cylinder head material.

Figure 13:
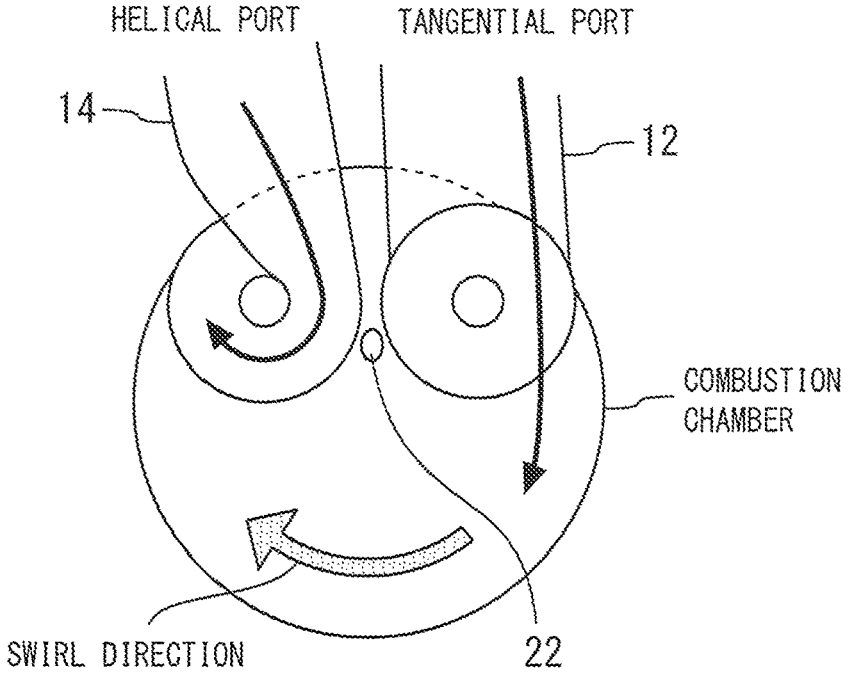
FIG. 13 is a perspective diagram for showing a combustion chamber seen from an upper side of a cylinder head on which a swirl generating port is informed.

In the embodiment mentioned above, the shape of the inlet ports 12, 14 was not particularly limited, but when the inlet ports 12, 14 are composed of swirl generation ports, various effects can be expected in relations with the film formation area around the CPS hole and the swirl direction. These effects are described with reference to FIG. 13 to FIG. 15. FIG. 13 is a perspective diagram for showing a combustion chamber seen from an upper side of a cylinder head on which a swirl generating port is informed. In FIG. 13, the intake port 12 is formed as a tangential port for generating a swirl in the combustion chamber while the intake port 14 is formed as a helical port for securing flow quantity of intake air flowed into the combustion chamber. The swirl generated in the combustion chamber flows in the clockwise direction shown in FIG. 13. Therefore, on the basis of the swirl direction, the intake port 12 is positioned downstream of the swirl direction while the intake port 14 is positioned upstream of the swirl direction.

Figure 14:
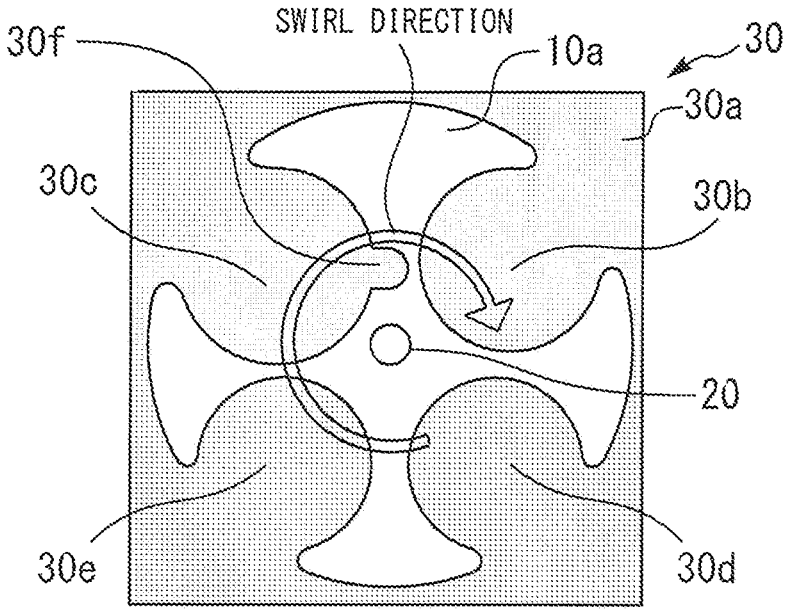
FIG. 14 is a diagram for describing a part of the masking member in a state of being attached to the casting product of the cylinder head of FIG. 13.
Figure 15:
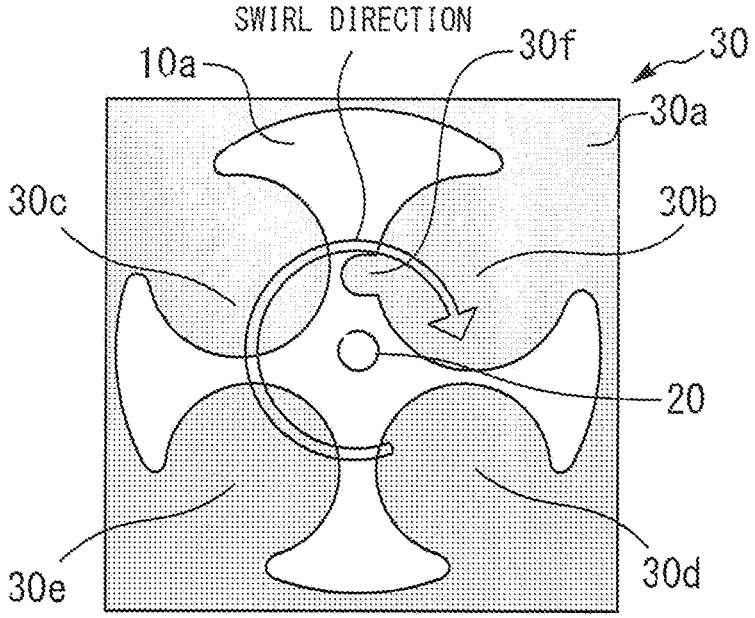
FIG. 15 is a diagram for describing a part of the masking member in a state of being attached to the casting product of the cylinder head of FIG. 13.

FIGS. 14 and 15 are diagrams for describing a part of the masking member in a state of being attached to the casting product of the cylinder head of FIG. 13. Likewise the embodiment mentioned above, when the masking member 30 with the mask portions 30*f* and 30*c* being directly linked with each other is used (see FIG. 14), then the heat shield film is unformed on the area between an opening of the intake port 14 and an opening of the CPS hole 22 described in FIG. 13. That is, the heat shield film is unformed on the upstream of the swirl direction. Therefore, compared with a case where the heat shield film is unformed on the area between the openings of the intake port 14 and the CPS hole 22 described in FIG. 13, heat influence of the sensor from the heat shield film becomes small and the measurement precision with a cylinder internal pressure sensor can be improved.

In contrast to the above, when the masking member 30 with the mask portions 30*f* and 30*b* being directly linked with each other is used (see FIG. 15), then the heat shield film is formed on the area between the openings of the intake port 14 and the CPS hole 22 described in FIG. 13. That is, the heat shield film is formed on the upstream of the swirl direction. Therefore, compared with the case where the heat shield film is unformed on the area between the openings of the intake port 14 and the CPS hole 22 described in FIG. 13, temperature around the CPS hole 22 is raised and thus, it makes possible to prevent an accumulation of deposit caused by unburned fuel or soot from occurring. Further, compared with the case where the heat shield film is unformed on the area between the openings of the intake port 14 and the CPS hole 22 described in FIG. 13, it makes possible to prevent mixed gas of intake air and fuel that flows over the CPS hole 22 from cooling down thereby the ignitability of the glow plug can be improved.

In the embodiment mentioned above, the glow plug-integrated cylinder internal pressure sensor is housed in the cylinder head. However, a glow plug and an internal pressure sensor may be separately housed in the cylinder head. In this case, a hole for housing the glow plug and a hole for housing the internal pressure sensor may be formed separately on the wall constitute surface.

In the embodiment mentioned above, the cylinder head is described as a cylinder head for a compression self-ignition type engine. However, the cylinder head may be a cylinder head for a spark ignition type engine. In the spark ignition type engine, a spark plug is housed in the cylinder head substitute for the glow plug-integrated cylinder internal pressure sensor. The spark plug is generally housed on the center portion of the wall constitute surface of the combustion chamber (i.e. the position of the injector hole 20 shown in FIG. 2). When two spark plugs are housed, however, one of the spark plugs may be housed in a hole between the two intake ports like the glow plug-integrated cylinder internal pressure sensor mentioned above. In this case, the one of the spark plugs may be housed in the CPS hole 22 shown in FIG. 13.

If the swirl generating port described in FIG. 13 is applied to the spark ignition type engine, various effects can be expected in relations with the film formation area around a hole for the one of the spark plugs between the intake ports (hereinafter referred to as "spark plug hole") and the swirl direction. Note that the following description is based on the assumption that the injector hole is positioned on the CPS hole 22 shown in FIG. 13.

Specifically, when the masking member 30 with the mask portions 30*f* and 30*c* being directly linked with each other is used (see FIG. 14), then the heat shield film is unformed on the area between the opening of the intake port 14 described in FIG. 13 and an opening of the spark plug hole. That is, the heat shield film is unformed on the upstream of the swirl direction. Therefore, compared with a case where the heat shield film is formed on the area between the openings of the intake port 14 described in FIG. 13 and the spark plug hole, temperature of the mixed gas flowing over the spark plug is lowered and thus, it makes possible to prevent an knocking from occurring. Further, in this case, the heat shield film is formed on the area between the opening of the intake port 12 described in FIG. 13 and the opening of the spark plug hole. That is, the heat shield film is formed on the downstream of the swirl direction. Therefore, compared with a case where the heat shield film is unformed on the area between the openings of the intake port 12 described in FIG. 13 and the spark plug hole, it makes possible to prevent temperature of frame that is ignited by the spark plug and is flowed by the swirl from decreasing.

In contrast to the above, when the masking member 30 with the mask portions 30*f* and 30*b* being directly linked with each other is used (see FIG. 15), then the heat shield film is formed on the area between the openings of the intake port 14 described in FIG. 13 and the spark plug hole. That is, the heat shield film is formed on the upstream of the swirl direction. Therefore, compared with a case where the heat shield film is unformed on the area between the openings of the intake port 14 described in FIG. 13 and the spark plug hole, it makes possible to prevent mixed gas that flows over the spark plug hole from cooling down thereby the ignitability of the spark plug can be improved.

Summarizing the above, there is a possibility of the peeling of the heat shield film described with reference to FIGS. 9 to 11 will occur when a hole for housing an engine-related part is formed to slant from the vertical direction of the matching surface with the cylinder block. Supposing that the injector hole described in the embodiment mentioned above is formed to slant from the vertical direction of the matching surface with the cylinder block, the peeling of the heat shield will occur. In this regard, the present application is a useful method for solving the peeling of the heat shield film and thus, it can be said that the present application is the one that can be applied widely to manufacture a cylinder head with the hole for housing the engine-related part that is formed to slant from the vertical direction of the matching surface with the cylinder block (except for intake and exhaust valves).

What is claimed is:

1. A manufacturing method for a cylinder head comprising:

a preparation step for preparing a cylinder head material having in a common plane a matching surface with a cylinder block and a wall constituent surface of an engine combustion chamber, wherein the wall constituent surface has port holes that correspond to an intake port and an exhaust port, and a slant hole for an engine-related part that is different from the port holes and slants from a vertical direction of the matching surface with the cylinder block;

an attaching step for attaching the cylinder head material to a masking member that is configured to mask a non-film formation area of the wall constituent surface and the matching surface with the cylinder block;

a film formation step for, after the attachment of the masking member, injecting film material particles in a direction opposed to the matching surface with the cylinder block to form a heat shield film; and a detaching step for detaching the masking member from the cylinder head material after the formation of the heat shield film, wherein the masking member comprises:

a matching surface mask portion that is configured to mask the matching surface with the cylinder block;

port hole mask portions that are configured to link to the matching surface mask portion directly and to mask each of openings of the port holes; and a slant hole mask portion that is configured to link to any one of the port hole mask portions directly and to mask an opening of the slant hole.

2. The manufacturing method for a cylinder head according to claim 1, wherein a center of the opening of the slant hole is positioned between any two consecutive openings of the port holes and also positioned closer to one of the two consecutive openings of the port holes, and the slant hole mask portion is configured to link directly to one of the port hole mask portions that is configured to mask one of the two consecutive openings being positioned closer to the center of the opening whereas not to link directly to one of the port hole mask portions that is configured to mask one of the two consecutive openings being positioned farther to the center of the opening.

3. The manufacturing method for a cylinder head according to claim 1, wherein the intake port includes a tangential port and a helical port, a center of the opening of the slant hole is positioned between an opening of the tangential port and an opening of the helical port, and the slant hole mask portion is configured to link directly to one of the port hole mask portions that is configured to mask the opening of the tangential port whereas not to link directly to one of the port hole mask portions that is configured to mask the opening of the helical port.

4. The manufacturing method for a cylinder head according to claim 1, wherein the intake port includes a tangential port and a helical port, a center of the opening of the slant hole is positioned between an opening of the tangential port and an opening of the helical port, and the slant hole mask portion is configured to link directly to one of the port hole mask portions that is configured to mask the opening of the helical port whereas not to link directly to one of the port hole mask portions that is configured to mask the opening of the tangential port.

* * * * *